US008678841B2

(12) United States Patent
Wang et al.

(10) Patent No.: US 8,678,841 B2
(45) Date of Patent: Mar. 25, 2014

(54) ELECTRIC CONNECTOR WITH MECHANICAL SWITCHING FUNCTION

(75) Inventors: Ching-Shun Wang, New Taipei (TW); Chia-Ho Chang, New Taipei (TW); Yuan-Bin Tang, New Taipei (TW)

(73) Assignee: Advanced Connection Technology, Inc., New Taipei (TW)

( * ) Notice: Subject to any disclaimer, the term of this patent is extended or adjusted under 35 U.S.C. 154(b) by 23 days.

(21) Appl. No.: 13/586,075

(22) Filed: Aug. 15, 2012

(65) Prior Publication Data

US 2013/0210290 A1 Aug. 15, 2013

(30) Foreign Application Priority Data

Feb. 13, 2012 (TW) ..... 101104534 A
Feb. 13, 2012 (TW) ..... 101202550 U

(51) Int. Cl.
*H01R 29/00* (2006.01)

(52) U.S. Cl.
USPC ..... 439/171; 439/660

(58) Field of Classification Search
USPC ..... 439/660, 166, 170–174, 189
See application file for complete search history.

(56) References Cited

U.S. PATENT DOCUMENTS 7,121,850 B2 * 10/2006 Yeh ..... 439/131
2007/0178734 A1 * 8/2007 Chen ..... 439/172
2007/0178735 A1 * 8/2007 Chen ..... 439/172
2008/0119076 A1 * 5/2008 Teicher ..... 439/171
2013/0164993 A1 * 6/2013 Wang et al. ..... 439/676
2013/0189880 A1 * 7/2013 Wang et al. ..... 439/660
2013/0210290 A1 * 8/2013 Wang et al. ..... 439/682

FOREIGN PATENT DOCUMENTS

JP 3162616 U 9/2010
JP 3163896 U 11/2010
JP 3165977 U 2/2011
KR 20-2010-0004044 U 4/2010

* cited by examiner

*Primary Examiner* — Ross Gushi
(74) *Attorney, Agent, or Firm* — Muncy, Geissler, Olds & Lowe, P.C.

(57) ABSTRACT

An electric connector includes an insulating socket, a plurality of first socket terminals, a plurality of second socket terminals, a plurality of third socket terminals, a plurality of fourth socket terminals, a plurality of fifth socket terminals, and a mechanical moving member. The mechanical moving member is disposed between a first position and a second position of an insulating base. When the mechanical moving member is positioned at the first position, part of the third socket terminals are connected to the fifth socket terminals, the second socket terminals and the third socket terminals transmit a second signal meeting a second standard. When the mechanical moving member is positioned at the second position, part of the third socket terminals are connected to the fourth socket terminals, the first socket terminals and part of the third socket terminals transmit a third signal meeting a third standard.

8 Claims, 9 Drawing Sheets

ELECTRIC CONNECTOR WITH MECHANICAL SWITCHING FUNCTION

CROSS-REFERENCES TO RELATED APPLICATIONS

This non-provisional application claims priority under 35 U.S.C. §119(a) on Patent Application No. 101104534 and 101202550, both filed in Taiwan, R.O.C. on Feb. 13, 2012, the entire contents of which are hereby incorporated by reference.

BACKGROUND

1. Technical Field

The disclosure relates to an electric connector and in particular to an electric connector with a function of mechanically switching different types of transmitting signals.

2. Related Art

Electric devices are used widely. Increasingly, electric devices are required to be lightweight, and small in size. As a result, the volume of the electric connector disposed in the electric devices must be reduced, especially for those needing be installed with several electric connectors meeting different kinds of signal transmitting standard respectively so as to be capable of connecting with different kinds of connector plugs. Because each of the electric connectors occupies a volume as well as needs room to separate from one to each other, a waste in space results.

For instance, if the electric devices for providing digital media information are installed with HDMI (High-Definition Multimedia Interface) socket connector, USB (Universal Serial Bus) socket connector, earphone socket connector, and microphone socket connector individually, then a lot of space is wasted to install each socket connector.

There is therefore a need for technicians in the art to integrate several electric connectors, such as HDMI connectors and USB connectors, to save space occupied by electric connectors. Meanwhile, a tamper resistant design must also be considered.

SUMMARY

Accordingly, an electric connector including an insulating base, a plurality of first socket terminals, a plurality of second socket terminals, a plurality of third socket terminals, a plurality of fourth socket terminals, a plurality of fifth socket terminals, and a mechanical moving member is provided. The insulating base includes a socket and a tongue plate. The tongue plate includes a first tongue portion and a second tongue portion. The first tongue portion and the second tongue portion are different in thickness and disposed in the socket. The first socket terminals are disposed at one surface of the first tongue portion and transmitting a first signal meeting a first standard. The second socket terminals are disposed at one surface of the second tongue portion. The third socket terminals are disposed at another surface of the second tongue portion. The fourth socket terminals and the fifth socket terminals are disposed at the insulating base and separated from each other. The mechanical moving member is disposed between the first position and the second position of the insulating base. When the mechanical moving member is positioned at the first position, part of the third socket terminals are connected to the fifth socket terminals, the second socket terminals and the third socket terminals transmit a second signal meeting second standard. When the mechanical moving member is positioned at the second position, part of the third socket terminals are connected to the fourth socket terminals, the first socket terminals and the part of third socket terminals transmit a third signal meeting a third standard.

An electric connector including an insulating base, a plurality of first socket terminals, a plurality of second socket terminals, a plurality of third socket terminals, a plurality of fourth socket terminals, a plurality of fifth socket terminals, and a mechanical moving member is also provided. The mechanical moving member is disposed between a first position and a second position of the insulating base. When the mechanical moving member is positioned at the first position, part of the third socket terminals are connected to the fourth socket terminals, the first socket terminals and the third socket terminals transmit a third signal meeting a third standard. When the mechanical moving member is positioned at the second position, part of the third socket terminals are connected to the fifth socket terminals, the second socket terminals and part of the third socket terminals transmit a second signal meeting a second standard.

In the present disclosure, different modes of signal-transmitting are effectively switched by a movement of the mechanical moving member of the electric connector. Meanwhile, the insulating base of the electric connector includes a socket having different sizes of insert spaces and includes a first tongue portion and a second tongue portion which are different in thickness, so as to be connected with connector plugs which transmit different signals.

It is to be understood that both the foregoing general description and the following detailed description presented below are intended to provide an overview or framework for understanding the nature and character of the disclosure as it is claimed. The accompanying drawings are included to provide a further understanding of the disclosure, and are incorporated into and constitute a part of this specification. The drawings illustrate various embodiments of the disclosure, and together with the description serve to explain the principles and operations of the disclosure.

DETAILED DESCRIPTION

Figure 1:
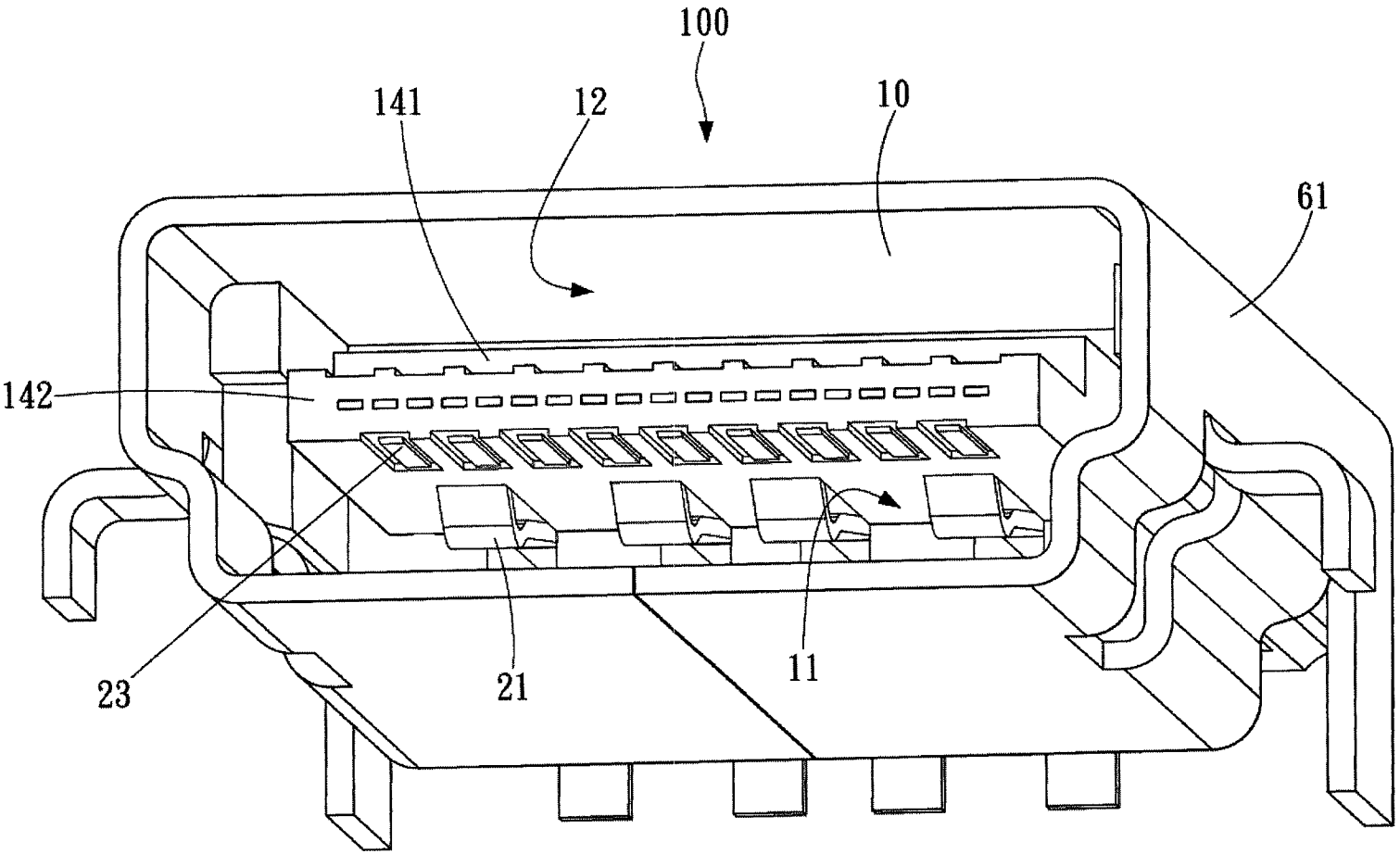
FIG. 1 is a schematic three-dimensional view of the present invention.
Figure 2:
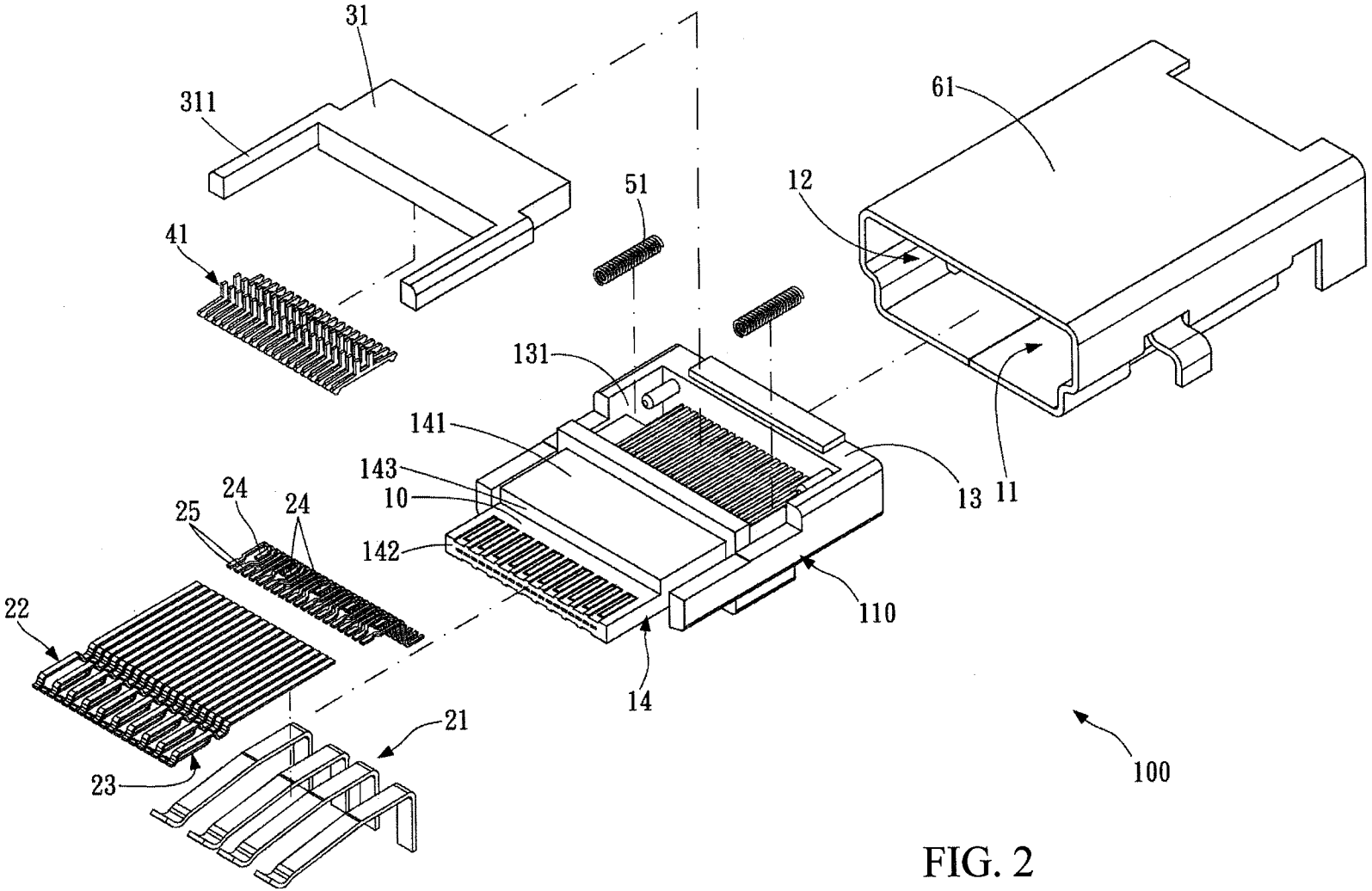
FIG. 2 is a schematic exploded view of the present invention.
Figure 3:
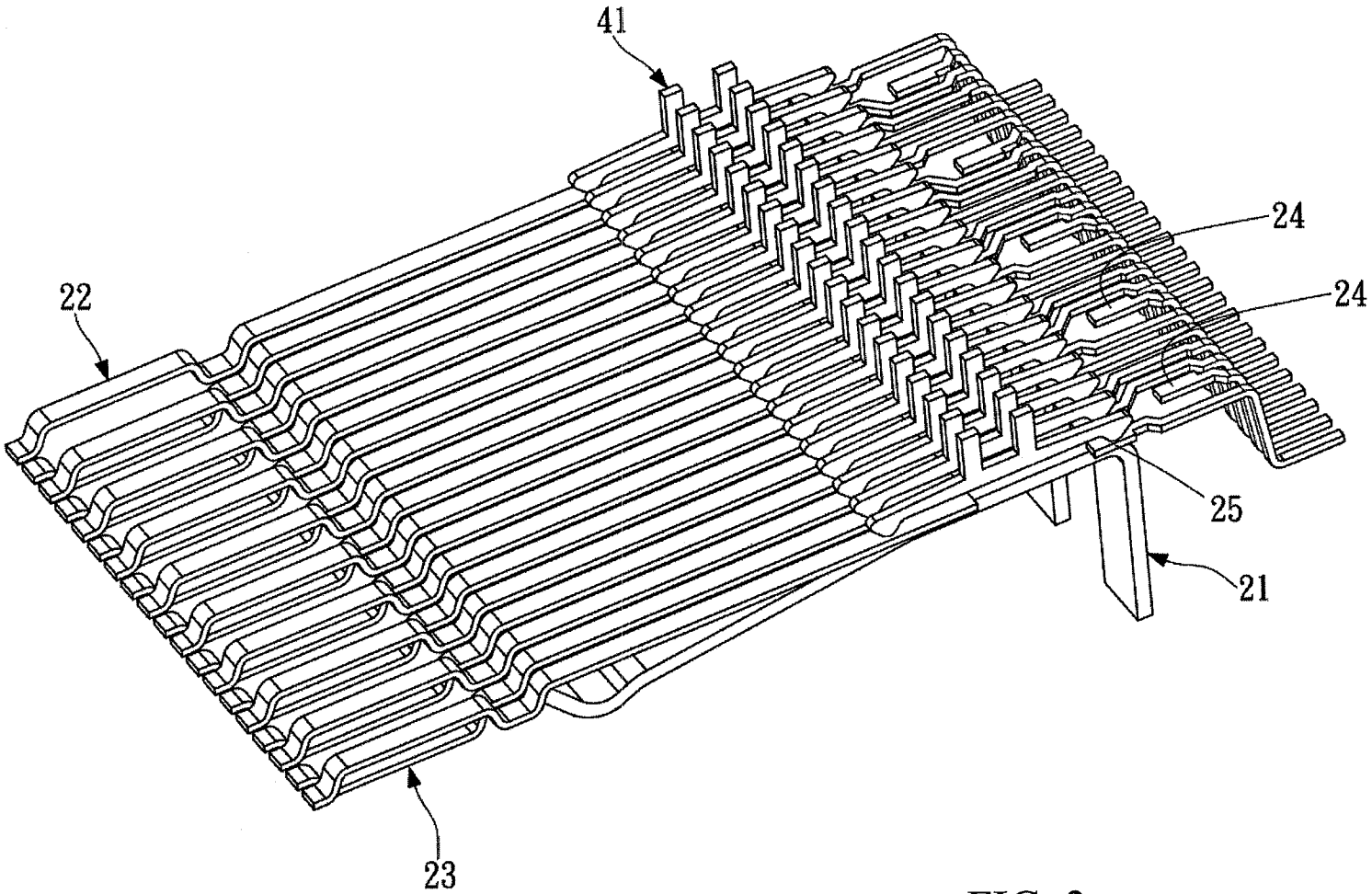
FIG. 3 is a schematic three-dimensional view of the terminals of the present invention.
Figure 4:
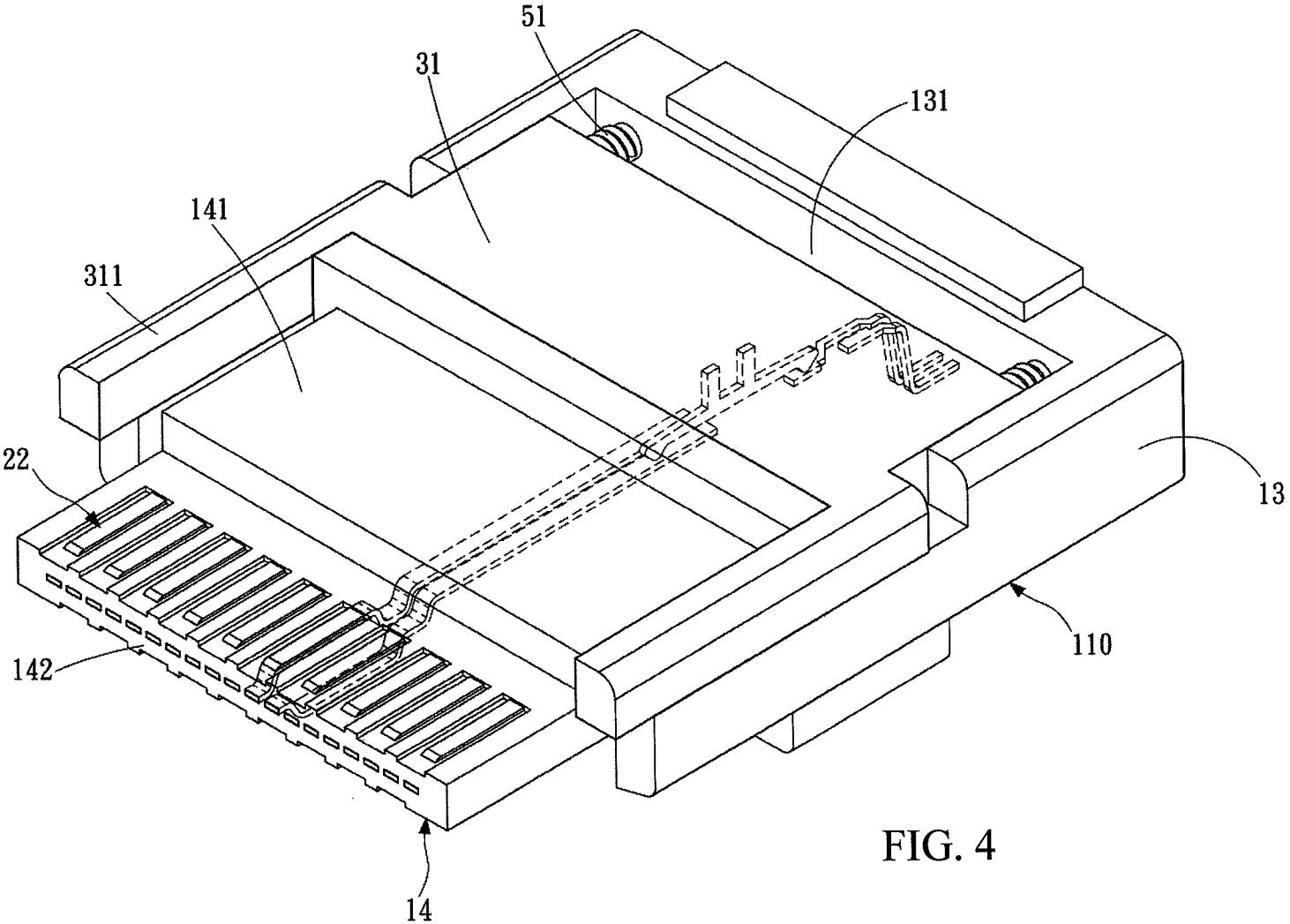
FIG. 4 is a schematic perspective view of the present invention.
Figure 5:
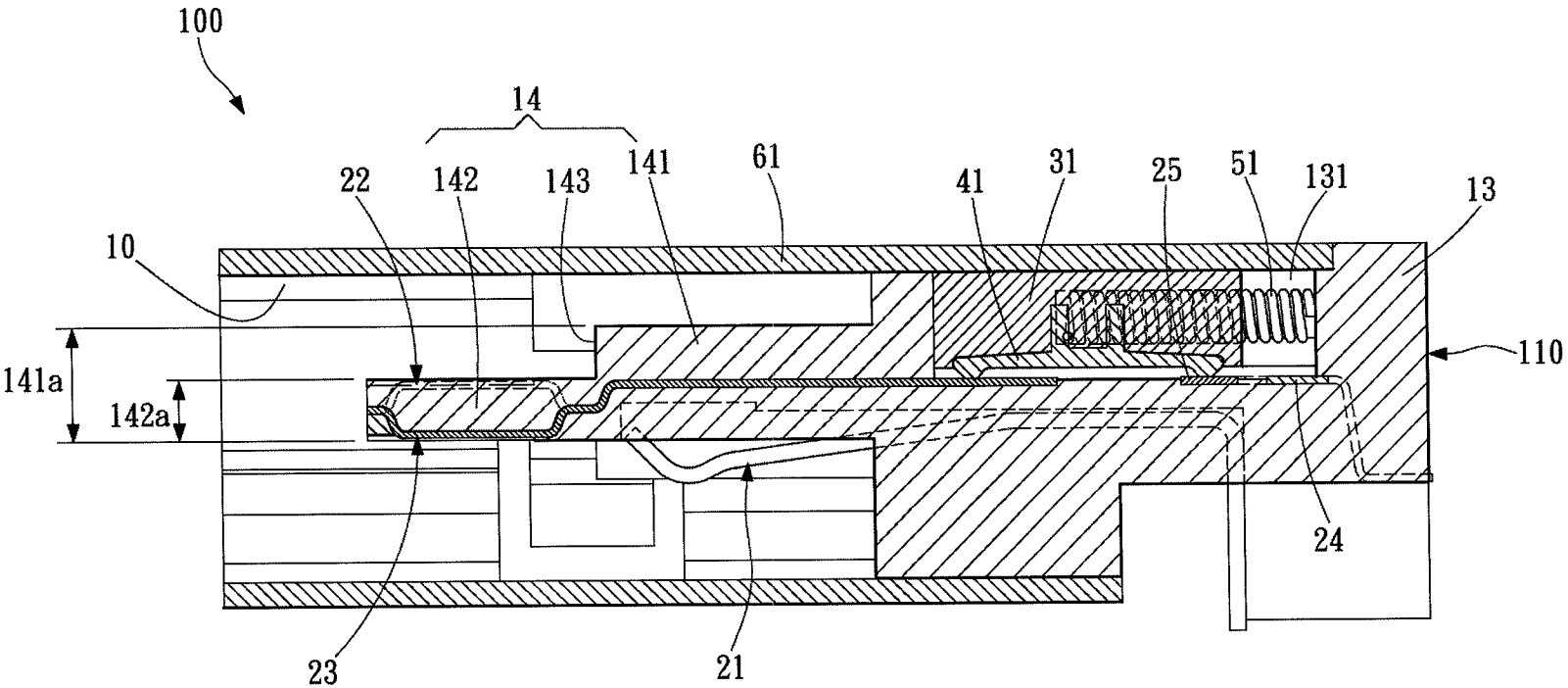
FIG. 5 is a schematic cross-sectional view of the present invention.
Figure 6:
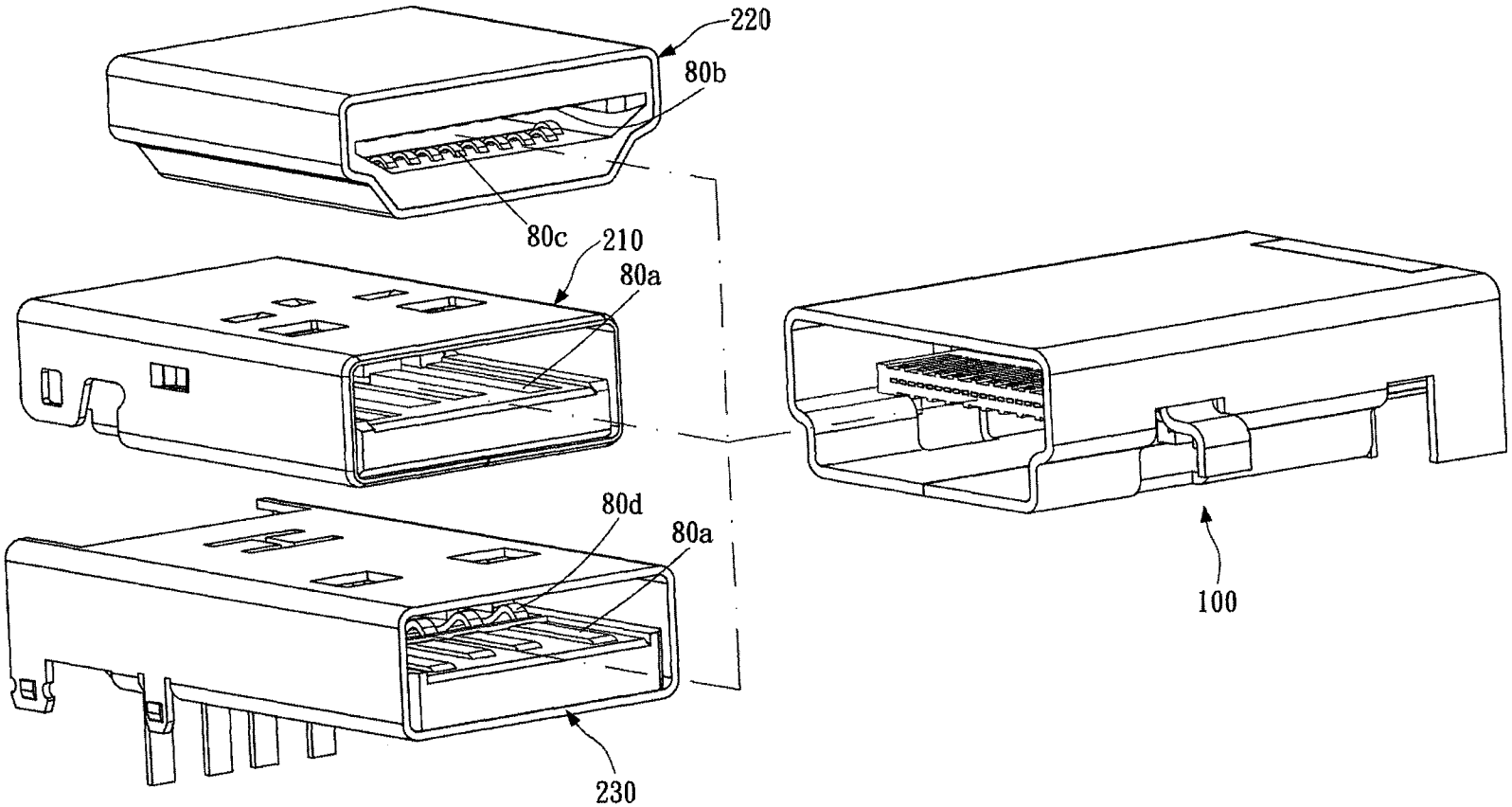
FIG. 6 is a schematic three-dimensional view of the present invention and a plug.

Please refer to FIG. 1 to FIG. 5, which are a schematic three-dimensional view, a schematic exploded view, a schematic three-dimensional view of the terminals, a schematic perspective view, and a schematic cross-sectional view of the first embodiment of the present invention.

According to the figures of the first embodiment, an electric connector 100 for connecting with a first connector plug 210 meeting the first standard, a second connector plug 220 meeting the second standard, or a third connector plug 230 meeting the third standard is disclosed. The electric connector 100 of the embodiment is may be merely inserted by a normal first connector plug meeting the first standard (ex. USB 2.0 signal), being merely inserted by a normal second connector plug 220 meeting the second standard (ex. HDMI signal or Display port signal), or being merely inserted by a third connector plug 230 (ex. USB 3.0 signal). The electric connector 100 includes an insulating base 110, a plurality of first socket terminals 21, a plurality of second socket terminals 22, a plurality of third socket terminals 23, a plurality of fourth socket terminals 24, a plurality of terminals 25, and a mechanical moving member 31.

Insulating base 110 is insulating and made from plastic materials. Insulating base 110 includes a socket 10, a body 13, and a tongue plate 14. Socket 10 of the first embodiment is formed by insulating base 110 covered by shell 40, but not limited to it. Alternatively, it is also practical to form socket 10 directly on insulating base 110 so as to omit shell 40. Socket 10 includes a first insert space 11 and a second insert space 12. In short, first insert space 11 meets a first standard and a third standard and second insert space 12 meets a second standard. The shape of first insert space 11 and second insert space 12 appears to be a reverse letter "T" as a whole. In this embodiment, the first standard is preferably the Universal Serial Bus 2.0 (USB 2.0), the second standard is preferably the High-Definition Multimedia Interface (HDMI) or display port, and the third standard is preferably the Universal Serial Bus 3.0 (USB 3.0). Additionally, the size of first insert space 11 is smaller than second insert opening 12.

The insulating base 110 includes body 13 and tongue plate 14. Preferably, tongue plated 14 is monolithically formed by an extension of one side of body 13, and an indenting slide 131 is disposed on body 13 and between tongue plated 14 and body 13. Tongue plate 14 includes a first tongue portion 141 and a second tongue portion 142 connected to each other. First tongue portion 141 has a first thickness 141*a* and connects to body 13. Second tongue portion 142 has a second thickness 142*a* different from first thickness 141*a*. In this embodiment, first thickness 141*a* is larger than second thickness 142*a*, and first tongue portion 141 and second tongue portion 142 are disposed in socket 10 (as shown, in FIG. 5).

First socket terminals 21 are disposed at insulating base 110 and one end of each of first socket terminals 12 is embedded in body 13. First socket terminals 21 are preferably combined with insulating base 110 by insert molding or in a separable manner. The other end of each of first socket terminals 21 is disposed at first tongue portion 141 and faces first insert space 11 so as to transmit the first signal meeting the first standard. This means that first socket terminals 21 transmit USB 2.0 signals. Preferably, the surface of the other end of each of first socket terminals 21 disposed at first tongue portion 141 is exposed. It should be noted that the other end of each of first socket terminals 21 is may be disposed at the surface or bottom of first tongue portion 141.

Second socket terminals 22 are disposed at a first surface of second tongue portion 142. In this embodiment, the first surface is opposite to the surface of first tongue portion 141 where first socket terminals 21 disposed at. One end of each of second socket terminals 22 faces the second insert space.

Third socket terminals 23 are disposed at a second surface of second tongue portion 142. In this embodiment, the second surface is the same to the surface of first tongue portion 141 where first socket terminals 21 disposed at. One end of each of third socket terminals 23 faces the second insert space 12. In this embodiment, the disclosed third socket terminals are disposed at tongue plate 14 but are not limited to it. For example, one end of part of third socket terminals 23 (ex. five third socket terminals), is disposed at tongue plate 14, while the other end is extending to body 13 directly.

Second socket terminals 22 and third socket terminals 23 transmit the second signal meeting the second standard. This means that second socket terminals 22 and third socket terminals 23 transmit HDMI signals or Display signals.

It is note that part of third socket terminals 23 (ex. five socket terminals) are capable of transmitting the third signal meeting the third standard with first socket terminals 21. This means that part of third socket terminals 23 and first socket terminals 21 transmit USB 3.0 signals.

One end of each of second socket terminals 22 and third socket terminals 23 are interlacedly facing first insert space 11 or facing second insert space 12. Second socket terminals 22 and third socket terminals 23 are preferably combined with insulating base 110 by insert molding or in a separable manner. The surface of the other end of each second socket terminals 22 and each third socket terminals 23 disposed at second tongue portion 142 is preferably exposed.

Fourth socket terminals 24 are disposed at body 13. In this embodiment, there are five fourth socket terminals 24. One end of each fourth socket terminals 24 is exposed at the slide 131 which is disposed between body 13 and tongue plate 14 but are not limited to it. The other end of each fourth socket terminals protrudes out of body 13 so as to connect to the outer electric circuit board.

Fifth socket terminals 25 are disposed at body 13. In this embodiment, fifth socket terminals 25 are disposed close to fourth socket terminals 24 and arranged in a horizontal level. Preferably, fifth socket terminals 25 are disposed at insulating base 110 and separated from fourth socket terminals 24, but not limited to it. It should be noted that the invention is not limited to having five fifth socket terminals 25. In another embodiment, there are more than five fifth socket terminals 25 are disposed at body 13. One end of each fifth socket terminals 25 is exposed at the slide 131 which is between the body 13 and tongue plate 14, but not limited to it. The other end of fifth socket terminals 25 are protruded out of body 13 so as to connect to the outer electric circuit board.

Mechanical moving member 31 is disposed between the first position and the second position of body 13. In this embodiment, mechanical moving member 31 is capable of sliding in slide 131. Mechanical moving member 31 includes an abutment block 311 which extends and protrudes to second space 12. A step surface 143 is formed between first tongue portion 141 and second tongue portion 142. Abutment block 311 extends to second space 12 and protrudes out of the step surface 143. A gap is formed between abutment block 311 and second tongue portion 142, and abutment block is dispose at side of second tongue portion 142. Additionally, abutment block can be disposed at central surface of first tongue portion 141 and face to first insert space 11.

The electric connector 100 in this embodiment further includes an elastic member 51 disposed between body 13 and mechanical moving member 31. When the mechanical moving member 31 moves, elastic member 51 provides an elastic force for mechanical moving member 31 so that mechanical moving member 31 is capable of returning to the original position. Elastic member 51 is preferably a spring, but not limited to it. Elastic member 51 can be a spring plate or other components with elasticity.

When electric connector 100 connects to connector plug 200 which transmits first signal (USB 2.0), second signal (HDMI or Display port), or third signal (USB 3.0), mechanical member is pushed by connector plug 200 to make the corresponding terminals be connected to each other.

When the mechanical moving member 31 is positioned at the first position, part of third socket terminals 23 are connected to fifth socket terminals 25, second socket terminals 22 and third socket terminals 23 transmit the second signal meeting second standard (ex. HDMI signal or Display signal). When the mechanical moving member 31 is positioned at the second position, part of third socket terminals 23 will be connected to fourth socket terminals 24, first socket terminals 21 and part of third socket terminals 23 transmit third signal meeting third standard (ex. USB 3.0).

Electric connector 100 in this embodiment further includes switch terminals 41 connected to mechanical moving member 31. When mechanical moving member 31 is positioned at the first position, switch terminals 41 are connected to part of third socket terminals 23 (ex. five third socket terminals), and fifth socket terminals 25, thereby second socket terminals 22 and third socket terminals 23 transmit second signal meeting second standard (ex. HDMI signal or Display port signal). When mechanical moving member 31 is positioned at the second position, switch terminals 41 are connected to part of third socket terminals 23 (ex. five third socket terminals), and fourth socket terminals 24, thereby first socket terminals 21 and part of third socket terminals 23 (ex. five third socket terminals), transmit third signal meeting third standard (ex. USB 3.0).

The present invention is not limited to the embodiment described previously. The second embodiment provides another signal-transmitting type. When mechanical moving member 31 is positioned at first position, part of third socket terminals 23 are connected to fourth socket terminals 24, first socket terminals 21 and part of third socket terminals 23 transmit third signal meeting third standard (ex. USB 3.0 signal). When mechanical moving member 31 is positioned at the second position, part of third socket terminals 23 are connected to fifth socket terminals 25, second socket terminals 22 and third socket terminals 23 transmit second signal meeting second standard (ex. HDMI or Display port). The above-mentioned is merely a kind of signal-transmitting type, and the present invention is not limited to it.

Electric connector 100 in the second embodiment further includes switch terminals 41 connected to mechanical moving member 31. When mechanical moving member 31 is positioned at the first position, switch terminals 41 are connected to part of third socket terminals 23 (ex. five third socket terminals), and fourth socket terminals 24, thereby first socket terminals 21 and part of third socket terminals 23 transmit third signal meeting third standard (ex. USB 3.0 signal). When mechanical moving member 31 is positioned at the second position, switch terminals 41 are connected to part of third socket terminals 23 (ex. five third socket terminals) and fifth socket terminals 25, thereby second socket terminals 22 and third socket terminals 23 transmit second signal meeting second standard (ex. HDMI signal or Display signal).

The quantity of first socket terminals is configured according to the requirement of the first standard, thereby transmit the first signal (ex. USB 2.0 signal). The quantities of second socket terminals 22 and third socket terminals 23 are configured according to the requirement second standard (ex. HDMI signal or Display port), thereby transmit the second signal. First socket terminals 21 and part of third socket terminals 23 transmit the third signal meeting standard (ex. USB 3.0). The person having ordinary skills in the art should know and understand how to alter the quantity of terminals to transmit more kind of signals according to the disclosure.

When one surface first tongue portion 141 and second tongue portion are formed as a plane, first tongue portion 141 and second tongue portion 142 face to the first insert space 11 or second insert space 12, and a gap is formed between the other end of each first socket terminals 21 and one end of each third socket terminals 23. The distance from first socket terminals 21 to the other end to one surface of first tongue portion 141 is greater than the distance from one end of part of third socket terminals 23 to one surface of second tongue portion 142. Therefore, when outer connector plug 200 inserts into electric connector 100, first plug terminals 80*a* of connector plug 200 are connected to first socket terminals 21 of electric connector 100, a gap is formed by the other end of first socket terminals 21 and one end of part of third socket terminals 23. Hence, a problem of short-cut or static-electricity interference resulting from first plug terminals 80*a* getting too close to third socket terminals 23 is prevented.

Figure 7:
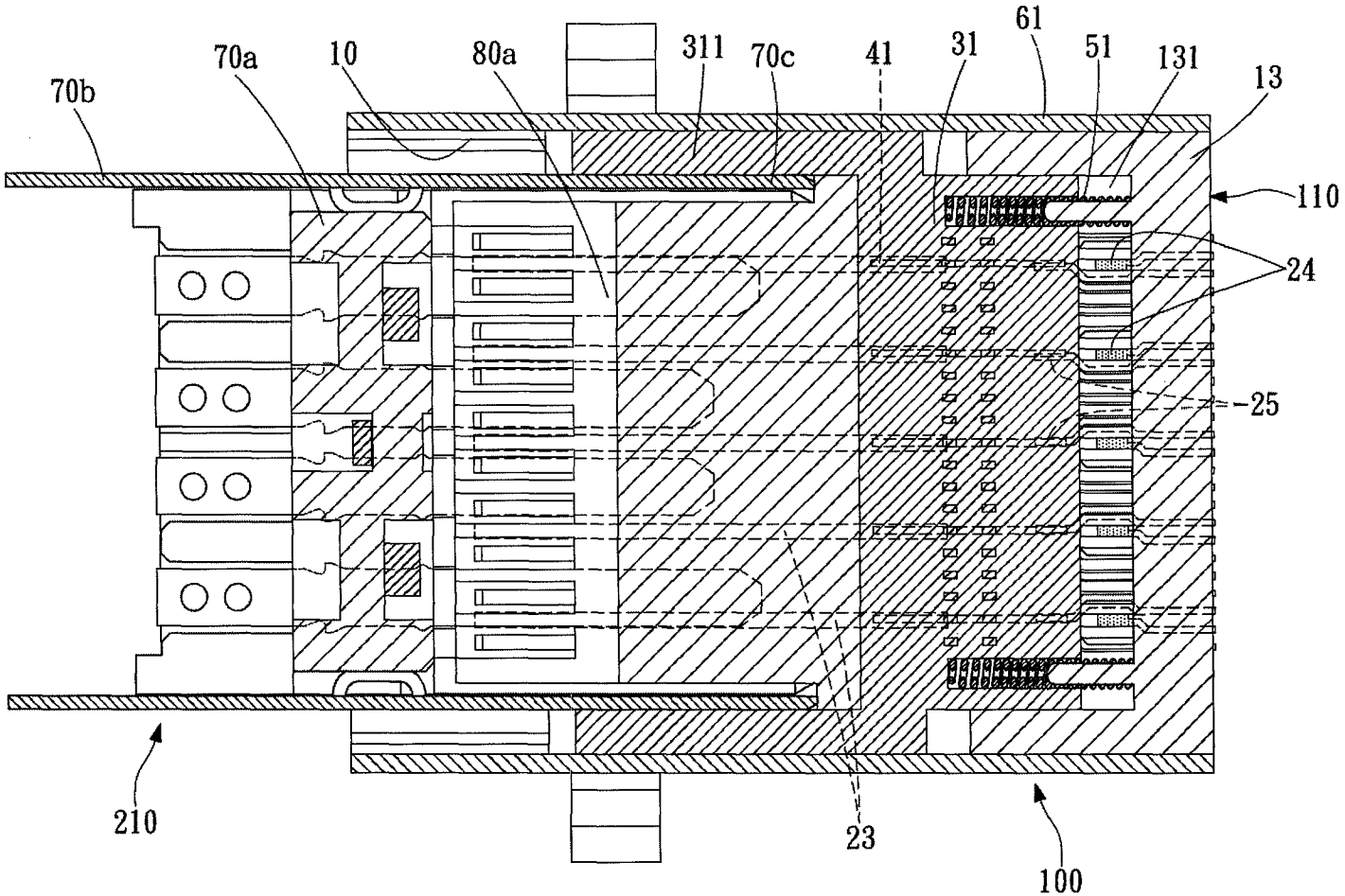
FIG. 7 is a schematic plan-cross-sectional view (1) of the present invention and a plug.
Figure 8:
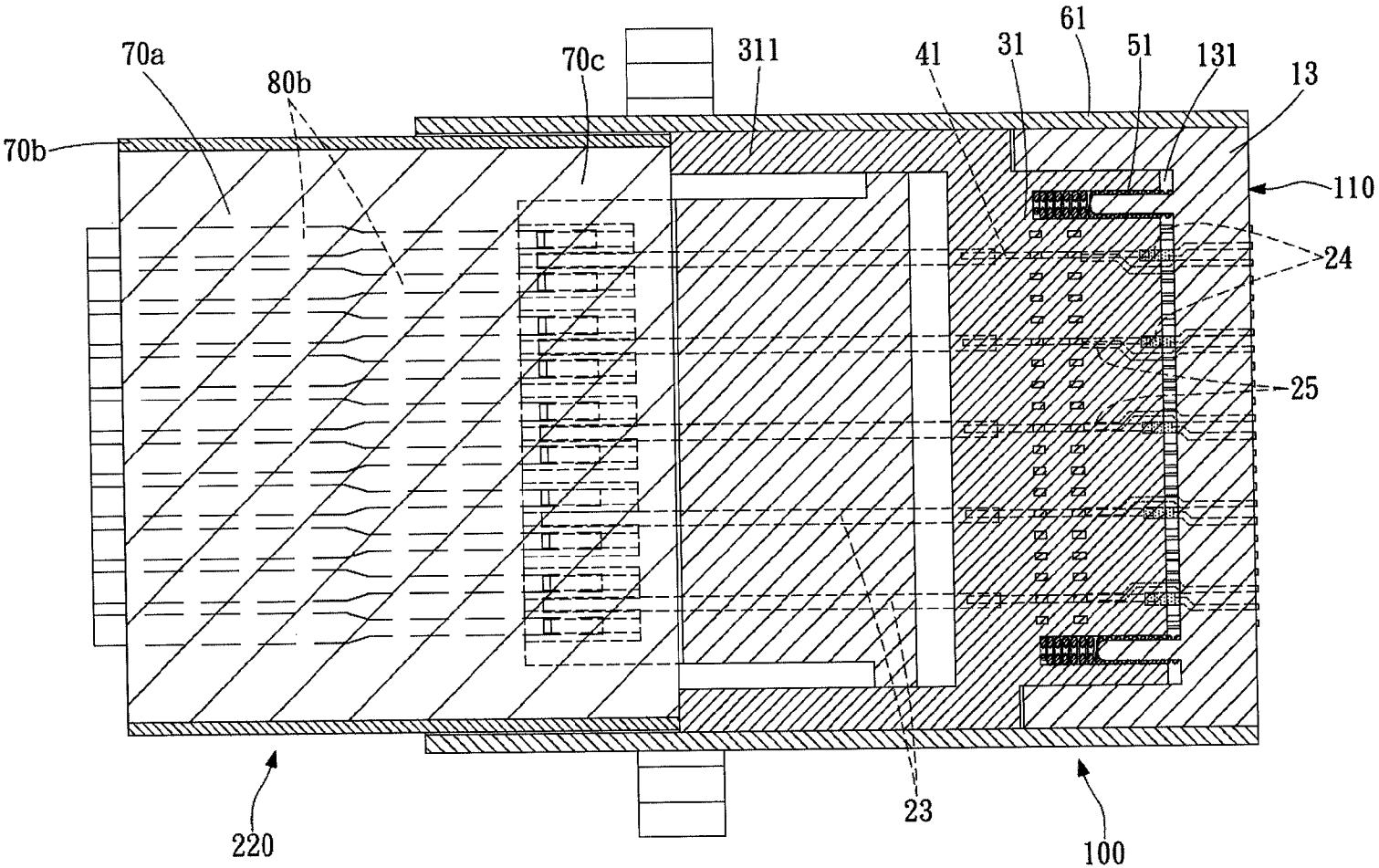
FIG. 8 is a schematic plan-cross-sectional view (2) of the present invention and a plug.
Figure 9:
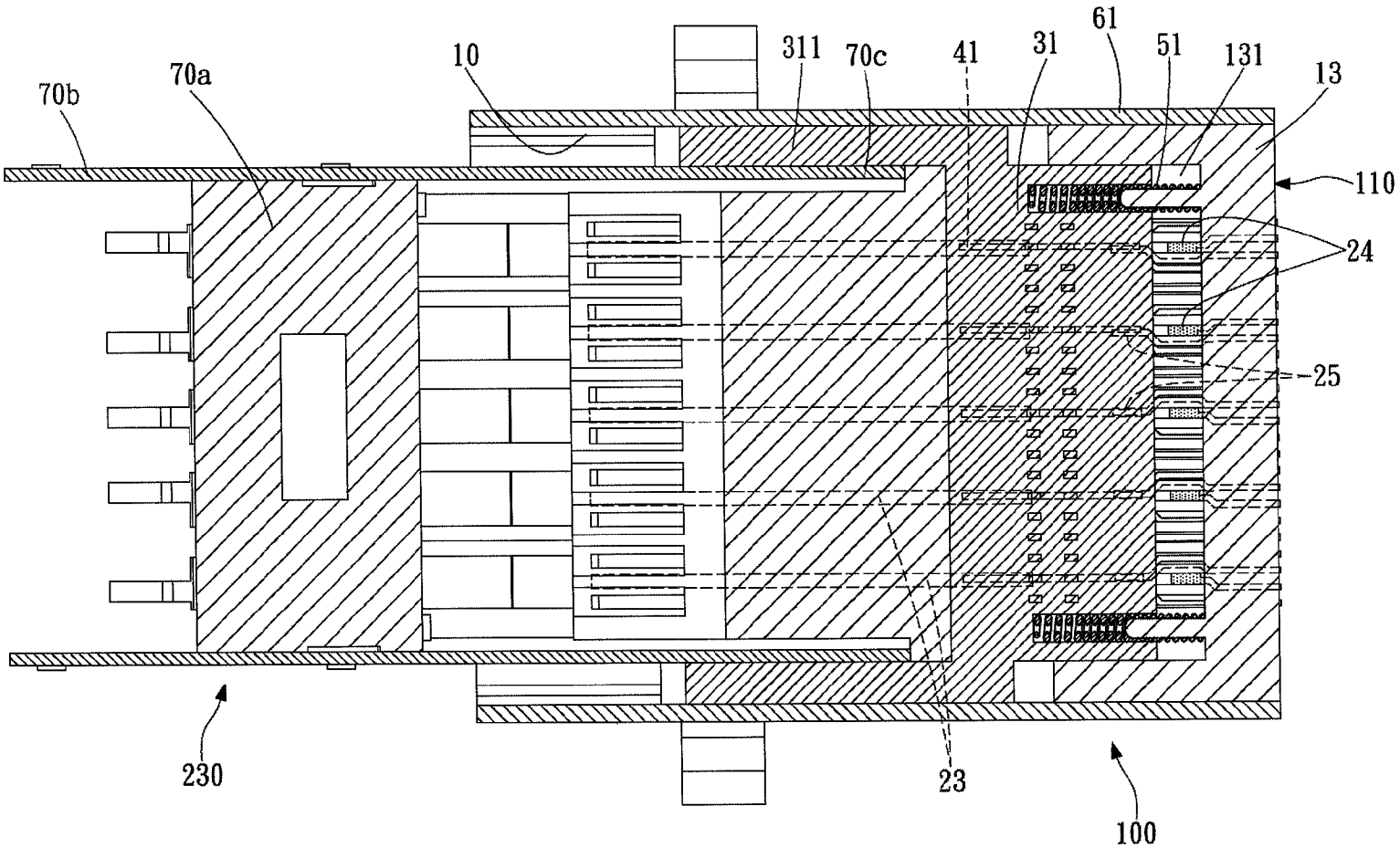
FIG. 9 is a schematic plan-cross-sectional view (3) of the present invention and a plug.

Please refer to FIG. 6 to FIG. 9. FIG. 7 illustrates electric connector 100 and first plug 210 transmitting the first signal (USB 2.0). FIG. 8 illustrates electric connector 100 and second plug 220 transmitting the second signal (HDMI or Display port). FIG. 9 illustrates electric connector 100 and third plug 230 transmitting third signal (USB 3.0). When transmitting the third signal is needed, one set of third socket terminals 23 is added to the first plug 210.

First plug 210 transmitting the first signal (USB 2.0), includes an insulating base 70*a*, shell 70*b*, insert portion 70*c*, a plurality of first plug terminals 80*a*. Second plug 220 transmitting the second signal (HDMI or Display port) includes an insulating base 70*a*, shell 70*b*, insert portion 70*c*, a plurality of second plug terminals 80*b*, a plurality of third plug terminals 80*c*. Third plug 230 includes an insulating base 70*a*, shell 70*b*, insert portion 70*c*, a plurality of first plug terminals 80*a* and a plurality of fourth plug terminals 80*d*. Since the previously mentioned plug 200 is the same as those electric plugs for transmitting USB 2.0, HDMI, or USB 3.0, no further unnecessary details are provided First plug 210 which transmits first signal (USB 2.0), inserts into first insert space 11 of electric connector 100 of the disclosure, abutting against first socket terminals 21 to transmit the first signal meeting the first standard. Third plug 230 which transmits third signal (USB 3.0), inserts into first insert space 11, abutting first socket terminals 21 and part of third socket terminals 23 to transmit the third signal meeting the third standard. Second plug 220 which transmits the second signal (HDMI or Display port), inserts into second insert space 12, abutting second socket terminals 22 and third socket terminals 23 to transmit the second signal meeting the second standard.

The embodiments mentioned above switch different types of transmitting signal by a movement of the mechanical moving member. Meanwhile, the insulating base of the electric connector includes a socket having different sizes of insert spaces and includes a first tongue portion and a second tongue portion which are different in thickness, so as to be connected with connector plugs which transmit different signals.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electric connector with a mechanical switching function, comprising:

an insulating base, comprising a socket and a tongue plate, the tongue plate comprises a first tongue portion and a second tongue portion, the first tongue portion and the second tongue portion are different in thickness and disposed in the socket;

a plurality of first socket terminals, disposed at one surface of the first tongue portion and transmitting a first signal;

a plurality of second socket terminals, disposed at one surface of the second tongue portion;

a plurality of third socket terminals, disposed at another surface of the second tongue portion;

a plurality of fourth socket terminals, disposed at the insulating base;

a plurality of fifth socket terminals, disposed at the insulating base and separated from the fourth socket terminals; and a mechanical moving member, disposed between the first position and the second position of the insulating base; when the mechanical moving member is positioned at the first position, part of the third socket terminals are connected to the fifth socket terminals, the second socket terminals and the third socket terminals transmit a second signal; when the mechanical moving member is positioned at the second position, part of the third socket terminals are connected to the fourth socket terminals, the first socket terminals and the part of third socket terminals transmit a third signal.

2. The electric connector according to claim 1, wherein the mechanical moving member comprises an abutment block, disposed at the insulating base and positioned in the socket.

3. The electric connector according to claim 1, further comprising a plurality of switch terminals connected to the mechanical moving member; when the mechanical moving member is positioned at the first position, the switch terminals are connected to the third socket terminals and the fifth socket terminals; when the mechanical moving member is positioned at the second position, the switch terminals are connected to the third socket terminals and the fourth socket terminals.

4. The electric connector according to claim 1, further comprising an elastic member, disposed between the insulating base and the mechanical moving member.

5. An electric connector with a mechanical switching function, comprising:

an insulating base, comprising a socket and a tongue plate, the tongue plate comprises a first tongue portion and a second tongue portion, the first tongue portion and the second tongue portion are different in thickness and disposed in the socket;

a plurality of first socket terminals, disposed at one surface of the first tongue portion and transmitting a first signal;

a plurality of second socket terminals, disposed at one surface of the second tongue portion;

a plurality of third socket terminals, disposed at another surface of the second tongue portion which is the same as the surface of the first tongue portion;

a plurality of fourth socket terminals, disposed at the insulating base;

a plurality of fifth socket terminals, disposed at the insulating base and separated from the fourth socket terminals; and a mechanical moving member, disposed between the first position and the second position of the insulating base; when the mechanical moving member is positioned at the first position, part of the third socket terminals are connected to the fourth socket terminals, the first socket terminals and the part of the third socket terminals transmit a third signal; when the mechanical moving member is positioned at the second position, part of the third socket terminals are connected to the fourth socket terminals, the first socket terminals and the part of the third socket terminals transmit a second signal.

6. The electric connector according to claim 5, wherein a step surface is disposed between the first tongue portion and the second tongue portion, the mechanical moving member comprises an abutment block disposed at the insulating base, the abutment extends to the outside of the socket and protrudes out of the step surface.

7. The electric connector according to claim 5, further comprising a plurality of switch terminals connected to the mechanical moving member; when the mechanical moving member is positioned at the first position, the switch terminals are connected to the third socket terminals and the fourth socket terminals; when the mechanical moving member is positioned at the second position, the switch terminals are connected to the third socket terminals and the fifth socket terminals.

8. The electric connector according to claim 5, further comprising an elastic member, disposed between the insulating base and the mechanical moving member.

* * * * *